US009484699B2

(12) United States Patent
Shedletsky et al.

(10) Patent No.: US 9,484,699 B2
(45) Date of Patent: Nov. 1, 2016

(54) ELASTOMERIC CONNECTORS

(71) Applicant: Apple Inc., Cupertino, CA (US)

(72) Inventors: Anna-Katrina Shedletsky, Mountain View, CA (US); Erik G. de Jong, San Francisco, CA (US); Fletcher R. Rothkopf, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 133 days.

(21) Appl. No.: 14/208,426

(22) Filed: Mar. 13, 2014

(65) Prior Publication Data

US 2015/0263450 A1 Sep. 17, 2015

(51) Int. Cl.
*H01R 13/40* (2006.01)
*H01R 43/00* (2006.01)
*H01R 13/24* (2006.01)

(52) U.S. Cl.
CPC ..... *H01R 43/007* (2013.01); *H01R 13/2414* (2013.01); *Y10T 29/49169* (2015.01)

(58) Field of Classification Search
CPC H01R 13/2414; H01R 13/53; H01R 13/658; H01R 13/7197; H01R 13/5213; H01R 13/5205
USPC ..... 439/588, 586, 587, 591, 81, 86, 88, 89, 439/90, 91, 66, 67
See application file for complete search history.

(56) References Cited

U.S. PATENT DOCUMENTS 3,743,890 A * 7/1973 Neu ..... H01L 23/48 174/260
3,795,037 A * 3/1974 Luttmer ..... H01R 12/714 174/541
4,295,700 A * 10/1981 Sado ..... H01R 13/2414 361/785
4,330,165 A * 5/1982 Sado ..... H01R 12/714 439/66
4,344,662 A * 8/1982 Dalamangas ..... H01R 12/714 439/331
4,349,241 A * 9/1982 Juris ..... H01R 13/65802 439/271
4,402,562 A * 9/1983 Sado ..... H01R 13/2414 439/66
4,449,774 A * 5/1984 Takashi ..... B29C 47/0004 428/85
4,533,976 A * 8/1985 Suwa ..... G11C 5/00 361/679.02
4,636,018 A * 1/1987 Stillie ..... H01R 12/714 439/592
4,643,498 A * 2/1987 Taniguchi ..... H01R 13/2414 439/278
5,096,426 A * 3/1992 Simpson ..... H01R 12/714 29/883
5,237,743 A * 8/1993 Busacco ..... H01R 4/26 29/874

(Continued)

OTHER PUBLICATIONS

Author Unknown, "Elastomeric Connector," wikipedia.org/w/index.php?oldid=545621347, 2 pages, at least as early as Mar. 13, 2014.

*Primary Examiner* — Amy Cohen Johnson
*Assistant Examiner* — Milagros Jeancharles

(57) ABSTRACT

In a first embodiment, an elastomeric connector may include conductive and nonconductive portions and a guide that at least partially surrounds the connector and transfers compression in at least two directions. In a second embodiment, an elastomeric connector includes conductive portions at least partially surrounded by a nonconductive portion that is at least partially surrounded by conductive material connectible to ground to shield. In a third embodiment, an elastomeric connector may include multiple conductive portions and a nonconductive portion. One of the conductive portions may be separated from a first other in a cross section of a first connection surface and a second one of the others outside the cross section. At least one of the conductive portions may be connected to at least one of the others within the connector. In a fourth embodiment, a sealing component may include conductive and nonconductive elastomeric material.

21 Claims, 13 Drawing Sheets

(56) References Cited

U.S. PATENT DOCUMENTS 5,635,670 A * 6/1997 Kubota ..... H01G 2/065 174/524
6,019,609 A 2/2000 Strange
6,019,610 A * 2/2000 Glatts, III ..... H01R 13/2414 439/66
6,685,487 B2 2/2004 Ward et al.
6,796,811 B1 * 9/2004 Pupkiewicz ..... H01R 13/2414 439/591
7,118,393 B1 10/2006 Pupkiewicz et al.
7,326,068 B2 2/2008 Sturm et al.
7,731,510 B2 * 6/2010 Tada ..... H01R 13/2414 439/591
7,878,820 B2 * 2/2011 Tada ..... H01R 12/79 439/495
8,043,096 B2 * 10/2011 Tanaka ..... B32B 7/02 439/591
8,210,857 B2 * 7/2012 Huynh ..... H01R 13/2428 349/149
2005/0224762 A1 * 10/2005 Hasegawa ..... H01R 13/2414 252/500
2007/0111566 A1 5/2007 Seibert et al.
2007/0254503 A1 11/2007 Bao et al.
2009/0246599 A1 * 10/2009 Beutel ..... H01M 8/0273 429/508
2014/0300832 A1 * 10/2014 de Jong ..... G06F 3/041 349/12

* cited by examiner

ELASTOMERIC CONNECTORS

TECHNICAL FIELD

This disclosure relates generally to connectors, and more specifically to elastomeric connectors.

BACKGROUND

Elastomeric connectors, such as those sold as ZEBRA™ connectors, may include rubberized layers of alternating elastomeric conductive and elastomeric nonconductive (i.e., insulating) materials. Such elastomeric connectors are often flexible and may be used as electrical conductors in applications that experience vibration, mechanical shock, and other forces acting on a system or device.

Typically, the elastomeric conductive layers may extend between two ends of such an elastomeric connector. In such cases, the elastomeric connector may be utilized to form an electrical connection by placing contacts on the two ends and compressing the elastomeric connector.

SUMMARY

The present disclosure discloses elastomeric connectors and systems and methods for forming and utilizing elastomeric connectors.

In a first embodiment, an elastomeric connector system may include an elastomeric connector and at least one guide element that at least partially surrounds the elastomeric connector. The elastomeric connector may include at least one conductive elastomeric material portion extending between a first connection surface and a second connection surface and at least one nonconductive elastomeric material portion. The guide element may transfer compression of the elastomeric connector from the first connection surface through at least two directions to the second connection surface.

In a second embodiment, an elastomeric connector includes one or more conductive elastomeric material portions at least partially surrounded by at least one nonconductive elastomeric material portion that is in turn at least partially surrounded by at least one additional conductive material elastomeric portion. The additional conductive material elastomeric portion may be connected to a ground in order to shield the conductive elastomeric material portion that is at least partially surrounded by the nonconductive elastomeric material portion.

In a third embodiment, an elastomeric connector may include at least three conductive elastomeric material portions extending from a first connection surface to a second connection surface and at least one nonconductive elastomeric material portion. One of the conductive elastomeric material portions may be separated from a first one of the other conductive elastomeric material portions by the nonconductive elastomeric material portion in a cross section of the first connection surface and a second one of the other conductive elastomeric material portions by the nonconductive elastomeric material portion outside the cross section of the first connection surface. In various implementations of this embodiment, one or more of the conductive elastomeric material portions may be connected to one or more of the other conductive elastomeric material portions within the elastomeric connector.

In a fourth embodiment, a sealing component may include at least one conductive elastomeric material and at least one nonconductive elastomeric material. The sealing component may be operable to seal at least a first component to a second component. Such a sealing component may be an o-ring. In various implementations of this embodiment, sealing the first component to the second component may result in the conductive elastomeric material being isolated from an external environment. In other implementations of this embodiment, sealing the first component to the second component may result in at least a portion of the conductive elastomeric material being exposed to an external environment. Regardless, in some implementations of this embodiment, sealing the first component to the second component may result in contact between contacts of the first and second components that compresses the sealing component and forms at least one electrical connection between the first and second components.

In various implementations, an elastomeric connector system includes an elastomeric connector with at least one conductive elastomeric material portion extending between at least a first connection surface and a second connection surface and at least one nonconductive elastomeric material portion and at least one guide element that at least partially surrounds the elastomeric connector. The guide element may transfer compression of the elastomeric connector from the first connection surface through at least two directions to the second connection surface.

In some implementations, an elastomeric connector includes a first conductive elastomeric material portion extending between at least a first connection surface and a second connection surface; a second conductive elastomeric material portion extending between the first connection surface and the second connection surface; a third elastomeric material portion extending between the first connection surface and a second connection surface; and at least one nonconductive elastomeric material portion. The first conductive elastomeric material portion may be separated from the second conductive elastomeric material portion by the at least one nonconductive elastomeric material portion in a cross section of the first connection surface. The first conductive elastomeric material portion may be separated from the third conductive elastomeric material portion by the at least one nonconductive elastomeric material portion outside the cross section of the first connection surface.

In one or more implementations, a sealing component system includes at least one conductive elastomeric material portion and at least one nonconductive elastomeric material portion. The sealing component may be operable to seal at least a first component to a second component.

In various implementations, a method of electrically coupling two components includes: placing an elastomeric connector at least partially within at least one guide element, the at elastomeric connector including at least one conductive elastomeric material portion extending between at least a first connection surface and a second connection surface and at least one nonconductive elastomeric material portion; electrically connecting a first component to a second component by contacting the first component to the first connection surface and the second component to the second connection surface; and transferring compression of the elastomeric connector associated with contact of the first component to the first connection surface from the first connection surface through at least two directions to the second connection surface utilizing the at least one guide element.

In some implementations, a method for electrically coupling and sealing two components includes: sealing a first component to a second component utilizing a sealing component that includes at least one elastomeric conductive portion and at least one elastomeric nonconductive portion; and compressing the sealing component between the first component and the second component to form an electrical connection between the first component and the second component utilizing the at least one elastomeric conductive portion.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

Figure 1A:
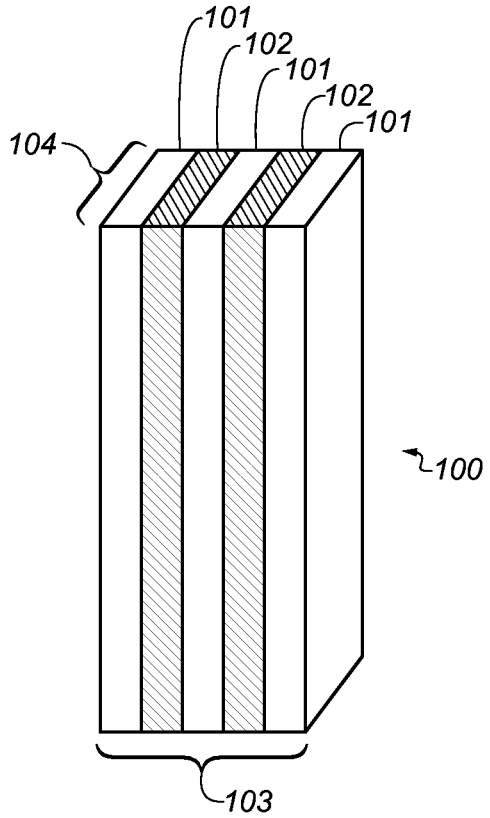
FIG. 1A is an isometric front view of a first example of an elastomeric connector.

The description that follows includes sample systems, methods, and computer program products that embody various elements of the present disclosure. However, it should be understood that the described embodiments may be practiced in a variety of forms in addition to those described herein.

The present disclosure discloses elastomeric connectors and systems and methods for forming and utilizing elastomeric connectors. A sample elastomeric connector may have multiple electrically conductive paths formed by conductive elastomeric material extending therethrough. Nonconductive elastomeric material may separate the electrically conductive paths.

In one embodiment, an elastomeric connector system may include an elastomeric connector and at least one guide element that at least partially surrounds the elastomeric connector. Such a guide element may be, but is not limited to, a hollow tube. The tube may have any cross-section, and is not limited to a round cross-section.

The elastomeric connector may include at least one conductive elastomeric material portion extending between a first connection surface and a second connection surface and at least one nonconductive elastomeric material portion. The guide element may permit the elastomeric connector to flex without compressing, or may be substantially rigid in order to resist flexing of the elastomeric connector when force is applied thereto. In this manner, an elastomeric connector may electrically connect electrical connections, pads, components, contacts and the like that are offset by a distance.

In certain embodiments, the elastomeric connector may have one or more segments that are angled with respect to an adjacent segment. The angle between segments may be any desired or suitable angle. An angled elastomeric connector may permit connections between electrical connections, pads, components, contacts and the like that are misaligned with respect to at least one axis. Further, such elastomeric connectors may pass around, over or otherwise avoid components that are positioned between electrical contacts.

In another embodiment, an elastomeric connector includes one or more conductive elastomeric material portions at least partially surrounded by at least one nonconductive elastomeric material portion that is, in turn, at least partially surrounded by at least one additional conductive material elastomeric portion. The additional conductive material elastomeric portion may be connected to a ground in order to shield the inner conductive elastomeric material portion.

In yet another embodiment, an elastomeric connector may include at least three conductive elastomeric material portions extending from a first connection surface to a second connection surface and at least one nonconductive elastomeric material portion. One of the conductive elastomeric material portions may be separated from a first one of the other conductive elastomeric material portions by the nonconductive elastomeric material portion in a cross section of the first connection surface and a second one of the other conductive elastomeric material portions may be separated by the nonconductive elastomeric material portion outside the cross section of the first connection surface.

In various implementations of this embodiment, one or more of the conductive elastomeric material portions may be connected to one or more of the other conductive elastomeric material portions within the elastomeric connector.

In still another embodiment, a sealing component may include at least one conductive elastomeric material and at least one nonconductive elastomeric material. The sealing component may be operable to seal at least a first component to a second component. Such a sealing component may be an o-ring.

In various implementations of this embodiment, sealing the first component to the second component may result in the conductive elastomeric material being isolated from an external environment. In other implementations of this embodiment, sealing the first component to the second component may result in at least a portion of the conductive elastomeric material being exposed to an external environment.

Regardless, in some implementations of this embodiment, sealing the first component to the second component may result in contact between contacts of the first and second components that compresses the sealing component and form at least one electrical connection between the first and second components.

FIG. 1A is an isometric front view of a first example of an elastomeric connector 100. As illustrated, the elastomeric connector 100 includes a number of parallel rows of nonconductive elastomeric material 101 and conductive elastomeric material 102 that extend from a top end to a bottom end.

Figure 1B:
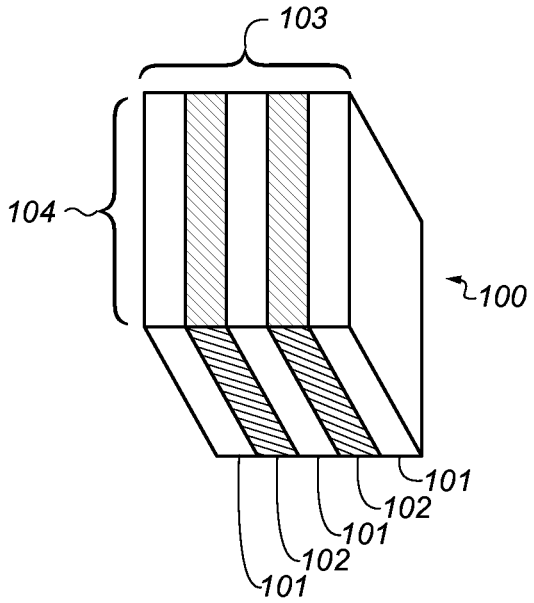
FIG. 1B is a top isometric view of the first example of an elastomeric connector of FIG. 1A.

FIG. 1B is a top isometric view of the first example of an elastomeric connector 100 of FIG. 1A. As illustrated, each of the rows 101 and 102 extends fully across a cross sectional thickness 104 of the elastomeric connector 100 and are arranged to alternate in parallel across a cross sectional width 103 of the elastomeric connector 100.

Figure 1C:
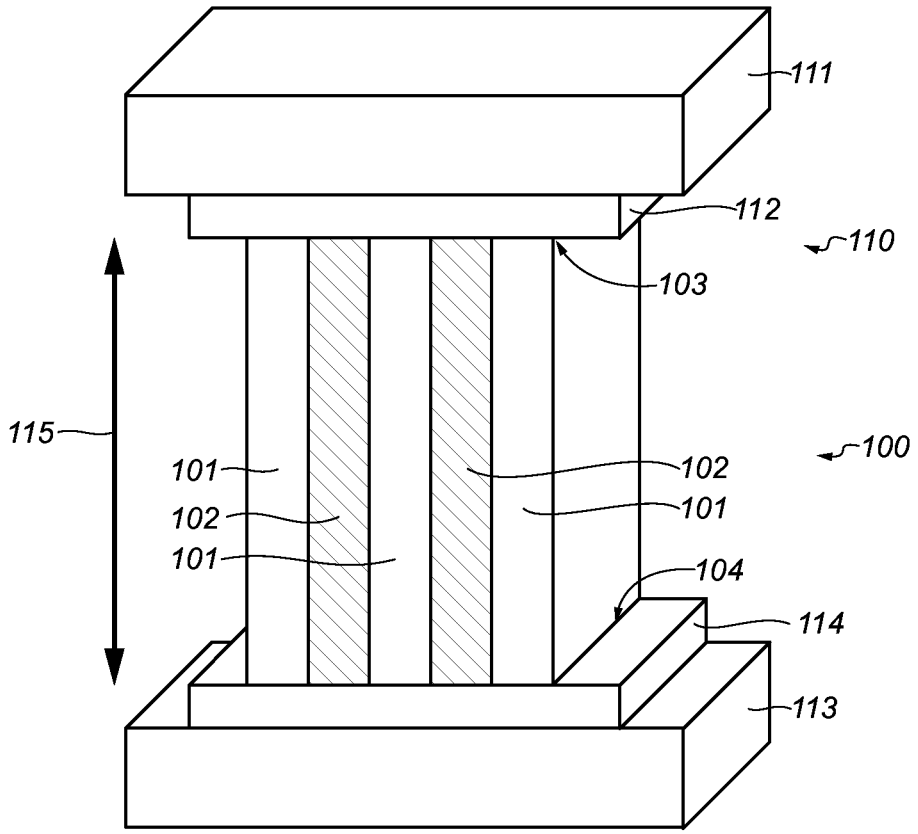
FIG. 1C is an isometric front view of the first example of an elastomeric connector of FIG. 1A being compressed between contact pads of two components.

FIG. 1C is an isometric front view of the first example of an elastomeric connector 100 of FIG. 1A being compressed in a single direction 115 between contact pads 112 and 114 of two components 111 and 113. As illustrated the top of the elastomeric connector 100 forms a first connection surface 103 that contacts the contact pad 112 and the bottom of the elastomeric connector 100 forms a first connection surface 104 that contacts the contact pad 113. Compression of the elastomeric connector 100 between the contact pads 112 and 114 may ensure that electrical connection is formed between the first and second components 111 and 113.

The first and second components 111 and 113 may be any kind of components that may be connected electrically. For example, the first component may be a touch display and the second component may be a smart phone, cellular telephone, computing device, tablet computing device, mobile computing device, laptop computing device, desktop computing device, wearable device, digital media player, and/or any other electronic device that may utilize a touch display. Further, it is understood that this is an example and is not intended to be limiting.

In various cases, either the first component 111 and/or the second component 113 may include various other components that are not shown. Such other components may include, but are not limited to, one or more processing units, one or more communication components, one or more non-transitory storage media (which may take the form of, but is not limited to, a magnetic storage medium; optical storage medium; magneto-optical storage medium; read only memory; random access memory; erasable programmable memory; flash memory; and so on), one or more input/output components, and/or any other components.

Additionally, with reference again to FIG. 1A, though the elastomeric connector 100 is illustrated and described as only having parallel rows of nonconductive elastomeric material 101 and conductive elastomeric material 102, it is understood that this is an example. In some cases, additional nonconductive elastomeric material may be positioned over the front and back surfaces of the elastomeric connector 100 such that the conductive elastomeric material 102 is only exposed at the top and bottom ends of the elastomeric connector 100.

Figure 2A:
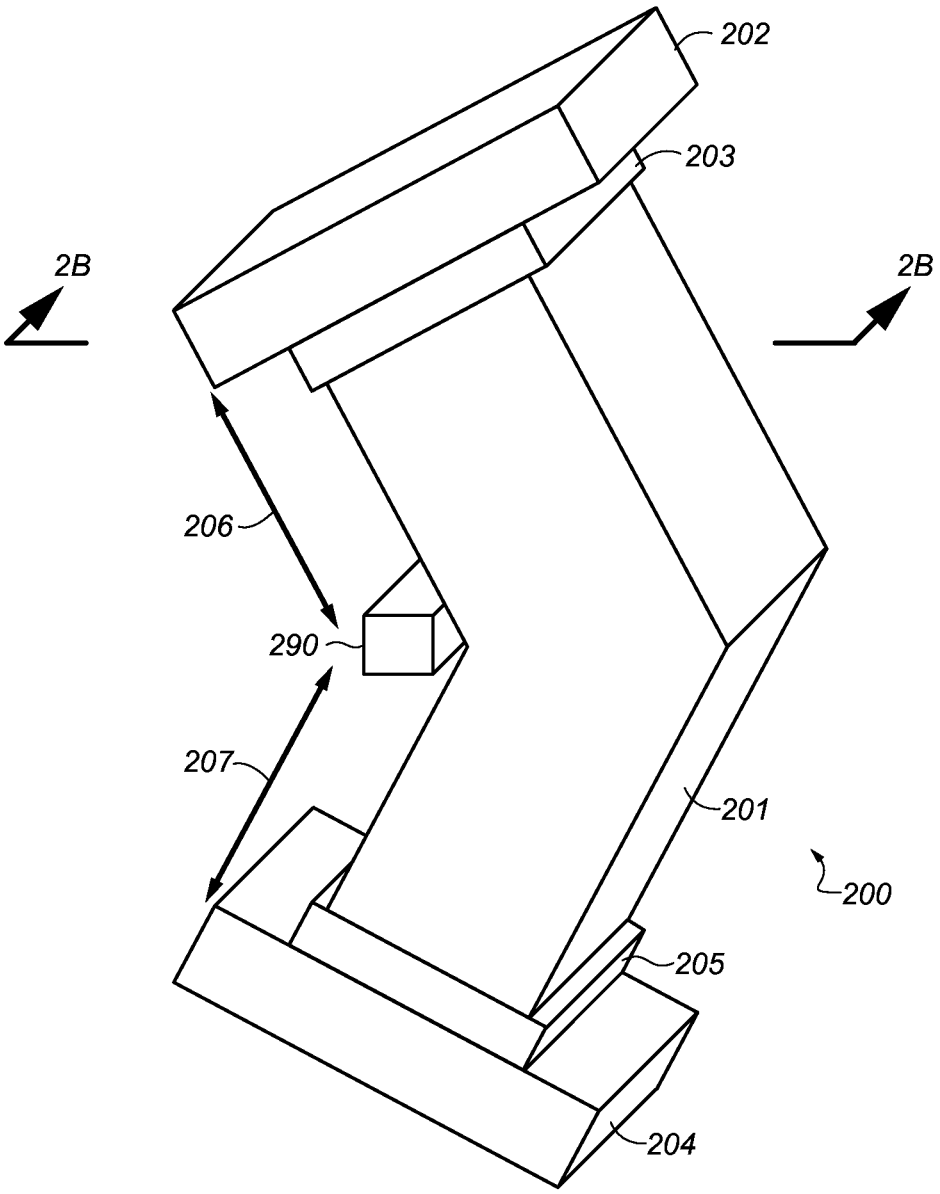
FIG. 2A is an isometric front view of an elastomeric connector system.

FIG. 2A is an isometric front view of an elastomeric connector system 200. A guide element 201 contains an elastomeric connector 208 (shown in FIG. 2B) and guides the elastomeric connector 208 in at least two directions 206 and 207 around a component 290 in order to electrically connect contact pads 203 and 205 of first and second components 202 and 204. As shown, the guide element may be a hollow tube, though this is an example and the guide element may be otherwise configured in other implementations. In this way, the contact pads 203 and 205 of first and second components 202 and 204 may be electrically connected even though component 209 is within the direct path between the two.

In some embodiments, portions of the elastomeric connector 208 may extend beyond the openings of the guide element 201. The extended portions of the connector 208 may be compressed by the contact pads 203, 205, thereby ensuring a tight and precise fit between the connector ends and pads. In other embodiments, the guide element 201 may completely enclose the elastomeric connector 208, and portions of the guide element 201 overlaying the conductive elastomeric material 102 may also be conductive, thereby electrically bridging the elastomeric connector 208 and the contact pads 203, 205.

Figure 2B:
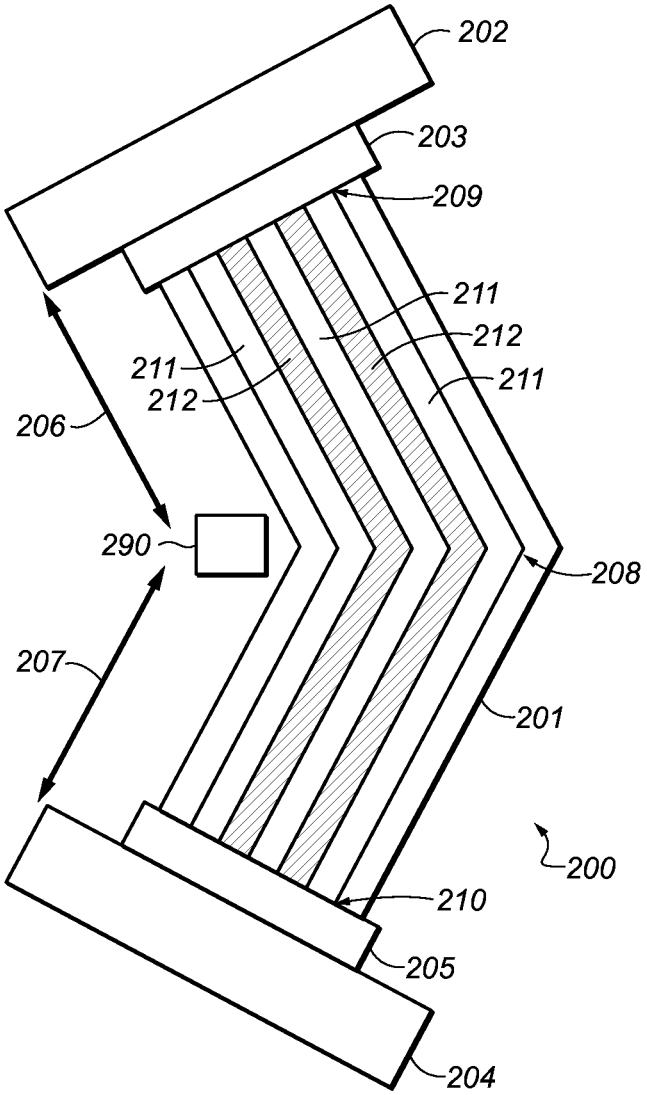
FIG. 2B is a cross-sectional view of the elastomeric connector system of FIG. 2A taken along line 2A of FIG. 2A.

FIG. 2B is a cross-sectional view of the elastomeric connector system 200 of FIG. 2A taken along line 2A of FIG. 2A. As illustrated, the elastomeric connector 208 may include nonconductive elastomeric material portions 211 and conductive elastomeric material portions 212 and may have a first connection surface 209 and a second connection surface 210.

When the contact pad 203 is contacted to the first connection surface 209 to compress the elastomeric connector 208, the guide element 201 may transfer the compression along the elastomeric connector in the direction 206 and then the direction 207 to the second connection surface 210. As such, the second connection surface may contact the contact pad 205 and the first and second components 202 and 204 may be electrically connected.

Similarly, when the contact pad 205 is contacted to the second connection surface 210 to compress the elastomeric connector 208, the guide element 201 may transfer the compression along the elastomeric connector in the direction 207 and then the direction 206 to the first connection surface 209. As such, the first connection surface may contact the contact pad 203 and the first and second components 202 and 204 may be electrically connected.

In some implementations, the guide element 201 may be made of a nonconductive material such as plastic. However, in other implementations the guide element may be made of a conductive material such as metal, while in yet other embodiments certain portions may be conductive and other portions nonconductive. In such a case, the guide element may be connected to a ground and may operate to shield the conductive portions 212.

Although the elastomeric connector 208 is illustrated as a particular number of rows of nonconductive elastomeric material portions 211 and conductive elastomeric material portions 212, it is understood that this is an example. In various implementations, other arrangements are possible without departing from the scope of the present disclosure. More or fewer rows may be present, structures other than rows may be used, the elastomeric connector may have multiple angles to form various shapes (such as a C-shape with hard transition angles) may have radiused or bent transitions between adjacent portions rather than hard transition angles, and so on.

By way of a first example, in various implementations the elastomeric connector 208 may include one or more conductive elastomeric material portions that are isolated from at least one additional conductive elastomeric material portion by one or more nonconductive elastomeric material portions. In such an example, the additional conductive elastomeric material portion may at least partially surround the nonconductive elastomeric material portions and be connected to a ground such that the additional conductive elastomeric material portion operates to shield the conductive elastomeric material portions.

By way of a second example, the elastomeric connector 208 may include at least three conductive elastomeric material portions extending from a first connection surface to a second connection surface and at least one nonconductive elastomeric material portion. One of the conductive elastomeric material portions may be separated from a first one of the other conductive elastomeric material portions by the nonconductive elastomeric material portion in a cross section taken in a plane along the first connection surface, and may be separated from a second one of the other conductive elastomeric material portions by the nonconductive elastomeric material portion in an area outside the cross-section. In some embodiments, one or more of the conductive elastomeric material portions may be connected within the elastomeric connector 208.

Additionally, although the guide element 201 is illustrated and described above as guiding compression of the elastomeric connector 208 in two particular directions 206 and 207, it is understood that this is an example. In various implementations, the guide element may be variously shaped in order to guide compression of the elastomeric connector 208 in any number of a variety of different directions without departing from the scope of the present disclosure.

In some cases, the elastomeric connector 208 may be formed separate from and/or outside of the guide element 201. In such cases, the elastomeric connector 208 may be inserted at least partially in the guide element once formed. In other cases, the elastomeric connector 208 may be formed inside the guide element, such as by injection molding, insertion molding, or other similar process.

In various implementations, the elastomeric connector 208 may be operable to perform as a sealing component to seal various components together.

Figure 3:
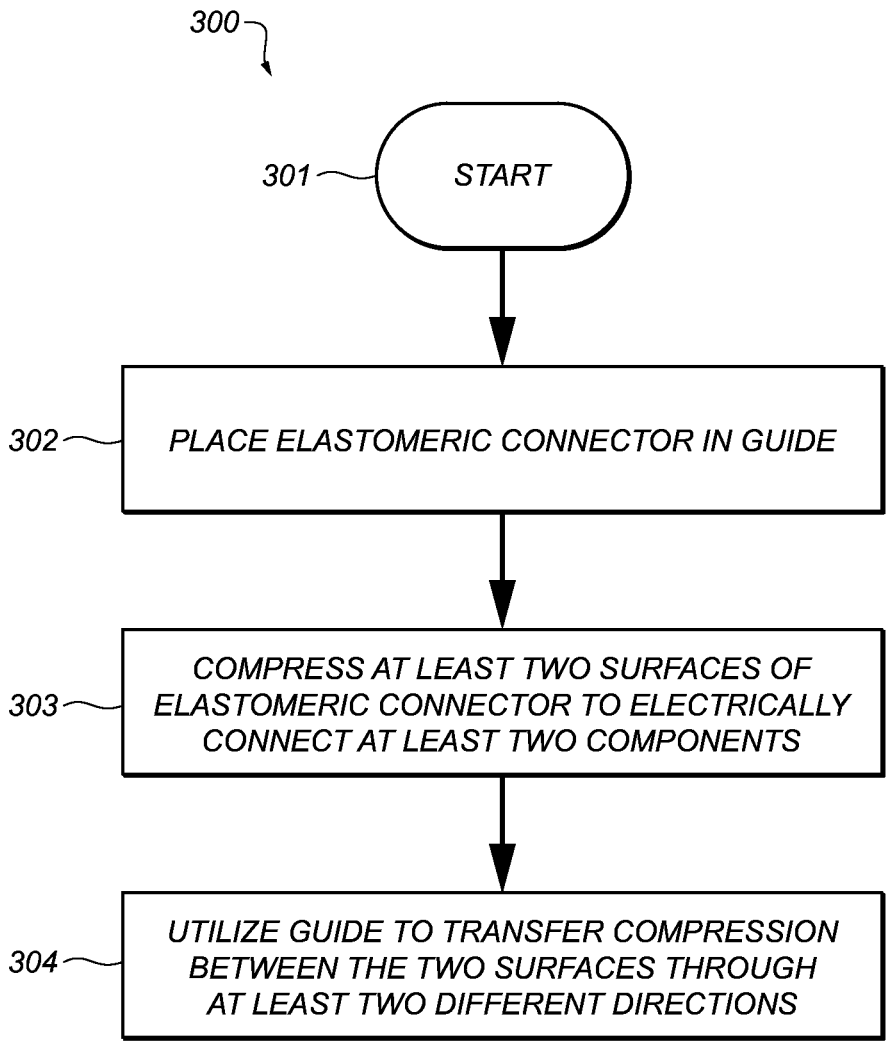
FIG. 3 is a method diagram illustrating an example method for utilizing an elastomeric connector system. This method may be performed by the system of FIGS. 2A-2B.

FIG. 3 is a method diagram illustrating an example method 300 for utilizing an elastomeric connector system. This method may be performed by the system of FIGS. 2A-2B.

The flow begins at block 301 and proceeds to block 302 where an elastomeric connector is placed in a guide element. The flow then proceeds to block 303 where at least two surfaces of the elastomeric connector are compressed to electrically connect at least two components. Next, the flow proceeds to block 304 where the guide element is utilized to transfer compression between the two surfaces through at least two different directions.

Although the method 300 is illustrated and described as including particular operations performed in a particular order, it is understood that this is an example. In various implementations, other configurations of the same, similar, and/or different operations may be performed without departing from the scope of the present disclosure.

For example, operations 303 and 304 are shown as separate operations performed in a linear order. However, in various implementations, compression of the two surfaces and utilization of the guide to transfer the compression between the two surfaces may be performed simultaneously.

Figure 4:
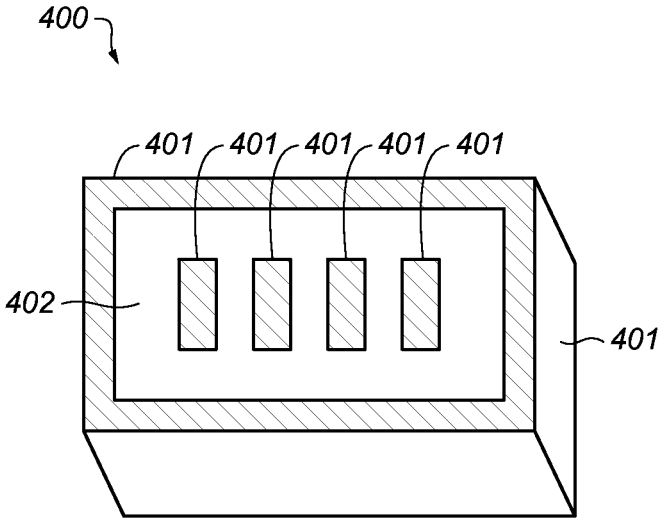
FIG. 4 is a top isometric view of a second example of an elastomeric connector.

FIG. 4 is a top isometric view of another example of an elastomeric connector 400. As illustrated, the elastomeric connector 400 includes a plurality of conductive elastomeric material portions 401 and at least one nonconductive elastomeric material portion 402. A number of the conductive elastomeric material portions 401 are isolated from an outer one of the conductive elastomeric material portions 401 by the nonconductive elastomeric material portion 402 and the outer one of the conductive elastomeric material portions 401 at least partially surrounds the nonconductive elastomeric material portion 402.

In some cases, the outer one of the conductive elastomeric material portions 401 may be grounded and may operate as a shield from the inner number of the conductive elastomeric material portions 401.

Although the elastomeric connector 400 is illustrated and described above as including a single nonconductive elastomeric material portion 402 and a particular number of inner conductive elastomeric material portions 401, it is understood that this is an example. In various implementations, any number of inner conductive elastomeric material portions 401 and nonconductive elastomeric material portions 402 may be utilized without departing from the scope of the present disclosure.

In various implementations, the elastomeric connector 400 may be operable to perform as a sealing component to seal at least two components together. When performing as a sealing component to seal at least two components, the conductive elastomeric material portions 401 may be isolated from an external environment in some implementations and exposed to the external environment in other embodiments.

Figure 5:
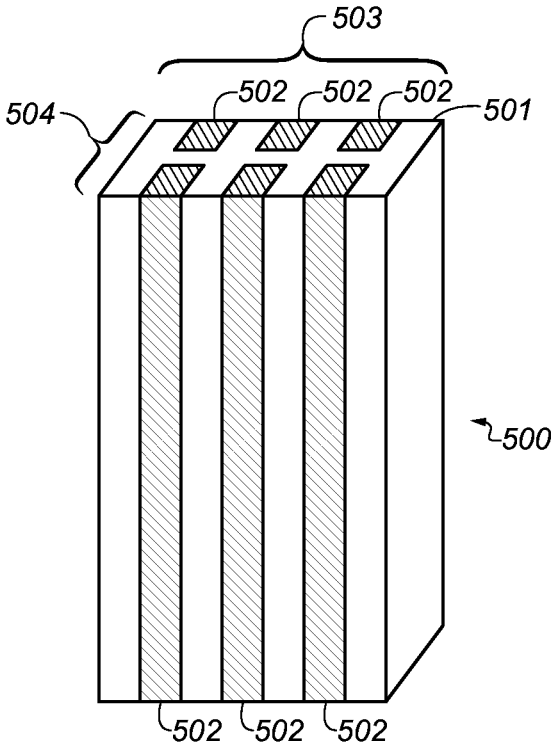
FIG. 5 is an isometric front view of a third example of an elastomeric connector.

FIG. 5 is an isometric front view of a third example of an elastomeric connector 500. As illustrated, the elastomeric connector 500 may include a number of conductive elastomeric material portions 502 extending from a bottom surface to a top surface and at least one nonconductive elastomeric material portion 501. As illustrated, conductive elastomeric material portions 502 are arranged in rows across a cross sectional width 503 of the top surface and a cross sectional thickness 504 of the top surface. As such, each of the conductive elastomeric material portions 502 are separated from the other conductive elastomeric material portions 502, along a width 503 of the connector, by the nonconductive elastomeric material portion 501. Likewise, each conductive elastomeric material portion 502 is separated from an adjacent conductive portion 502 by the nonconductive elastomeric material portion 501, as viewed along a length 504 of the connector. In this way, the number of possible connections that can be made via the top and bottom surfaces of the elastomeric connector 500 may be increased as compared to a connector utilizing a single, parallel set of conductive elastomeric conductive portions.

Although the elastomeric connector 500 is illustrated and described above as including a single nonconductive elastomeric material portion 501 and a particular number of conductive elastomeric material portions 502, it is understood that this is an example. In various implementations, any number of conductive elastomeric material portions 502 and nonconductive elastomeric material portions 501 may be utilized without departing from the scope of the present disclosure.

Further, although the elastomeric connector 500 is illustrated and described above as including four rows of conductive elastomeric material portions 502 in the cross sectional width 503 and two rows of conductive elastomeric material portions 502 in the cross sectional thickness 504, it is understood that this is an example. In various implementations, any number of rows in either the cross sectional width 503, the cross sectional thickness 504, and/or other cross sectional dimensions of the top or bottom surfaces of the elastomeric connector 500 may be utilized without departing from the scope of the present disclosure.

Moreover, though the rows of conductive elastomeric material portions 502 are shown as aligned, it is understood that this is an example. In various implementations one or more rows may be misaligned with one or more other rows without departing from the scope of the present disclosure.

In various implementations, the elastomeric connector 500 may be operable to perform as a sealing component to seal at least two components together. When performing as a sealing component to seal at least two components, the conductive elastomeric material portions 502 may be isolated from an external environment in some implementations and exposed to the external environment in other embodiments.

Further, in one or more implementations, the conductive elastomeric material portions 502 may be isolated from additional conductive portions (such as additional conductive elastomeric material, metal, and so on) by additional nonconductive portions (such as additional nonconductive elastomeric material, plastic, and so on) that at least partially surround the conductive elastomeric material portions 502 and nonconductive elastomeric material portion 501 and function as a shield for the conductive elastomeric material portions 502 when connected to a ground.

Figure 6A:
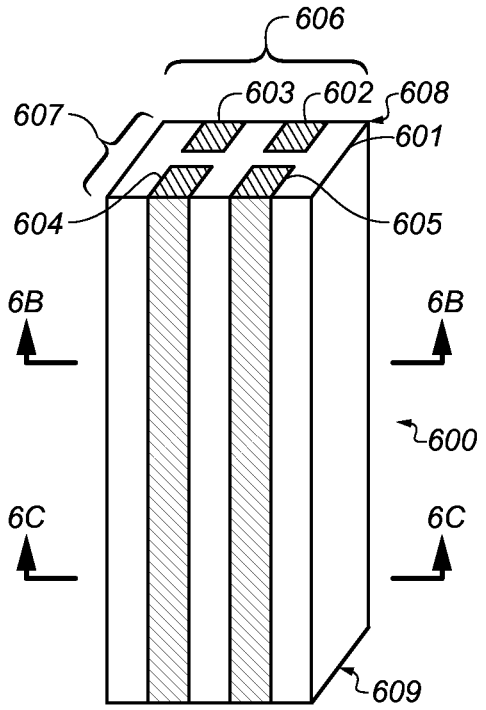
FIG. 6A is an isometric front view of a fourth example of an elastomeric connector.

FIG. 6A is an isometric front view of a fourth example of an elastomeric connector. As illustrated, the elastomeric connector 600 may include a number of conductive elastomeric material portions 602-605 extending from a bottom surface to a top surface and at least one nonconductive elastomeric material portion 601. As illustrated, conductive elastomeric material portions 602-605 are arranged in rows across a cross sectional width 606 of the top surface and a cross sectional thickness 607 of the top surface. As such, each of the conductive elastomeric material portions 602-605 are separated from the other conductive elastomeric material portions 602-605 of the cross sectional width 606 by the nonconductive elastomeric material portion 601 and the other conductive elastomeric material portion 602-605 of the cross sectional thickness 607 by the nonconductive elastomeric material portion 601.

Figure 6B:
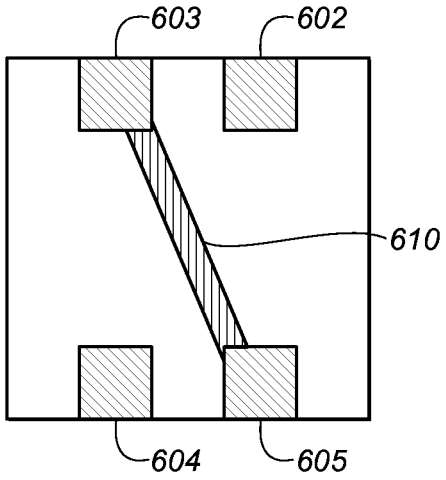
FIG. 6B is a cross-sectional view of the fourth example of an elastomeric connector of FIG. 6A taken along line 6B of FIG. 6A.
Figure 6C:
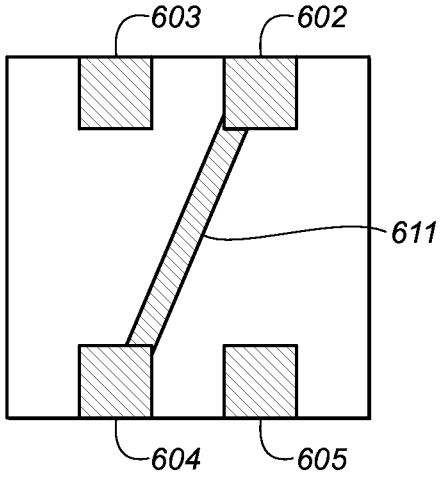
FIG. 6C is a cross-sectional view of the fourth example of an elastomeric connector of FIG. 6A taken along line 6C of FIG. 6A.

FIG. 6B is a cross-sectional view of the fourth example of an elastomeric connector of FIG. 6A taken along line 6B of FIG. 6A. As illustrated, the conductive elastomeric material portion 603 is connected to the conductive elastomeric material portion 605 by electrical connection mechanism 610. The electrical connection mechanism 610 may be any electrical conduction mechanism such as electrically conductive elastomeric materials, vias, metal, traces, and so on. Similarly, FIG. 6C is a cross-sectional view of the fourth example of an elastomeric connector of FIG. 6A taken along line 6C of FIG. 6A. As illustrated, the conductive elastomeric material portion 602 is connected to the conductive elastomeric material portion 604 by electrical connection mechanism 611. The electrical connection mechanism 611 may be any electrical conduction mechanism such as electrically conductive elastomeric materials, vias, metal, traces, and so on.

In this way, one or more conductive elastomeric portions 602-605 may be electrically connected without exposing that electrical connection on the outside of the elastomeric connector 600.

Although the elastomeric connector 600 is illustrated and described above as including a single nonconductive elastomeric material portion 601 and a particular number of conductive elastomeric material portions 602-605, it is understood that this is an example. In various implementations, any number of conductive elastomeric material portions 602-605 and nonconductive elastomeric material portions 601 may be utilized without departing from the scope of the present disclosure.

Further, although the elastomeric connector 600 is illustrated and described above as including two rows of conductive elastomeric material portions 602 and 603 or 605 and 604 in the cross sectional width 606 and two rows of conductive elastomeric material portions 602 and 605 or 603 and 604 in the cross sectional thickness 607, it is understood that this is an example. In various implementations, any number of rows in either the cross sectional width 606, the cross sectional thickness 607, and/or other cross sectional dimensions of the top or bottom surfaces of the elastomeric connector 600 may be utilized without departing from the scope of the present disclosure.

Moreover, though the rows of conductive elastomeric material portions 602-605 are shown as aligned, it is understood that this is an example. In various implementations one or more rows may be misaligned with one or more other rows without departing from the scope of the present disclosure.

In various implementations, the elastomeric connector 600 may be operable to perform as a sealing component to seal at least two components together. When performing as a sealing component to seal at least two components, the conductive elastomeric material portions 602-605 may be isolated from an external environment in some implementations and exposed to the external environment in other embodiments.

Further, in one or more implementations, the conductive elastomeric material portions 602-605 may be isolated from additional conductive portions (such as additional conductive elastomeric material, metal, and so on) by additional nonconductive portions (such as additional nonconductive elastomeric material, plastic, and so on) that at least partially surround the conductive elastomeric material portions 602-605 and nonconductive elastomeric material portion 601 and function as a shield for the conductive elastomeric material portions 602-605 when connected to a ground.

Figure 7A:
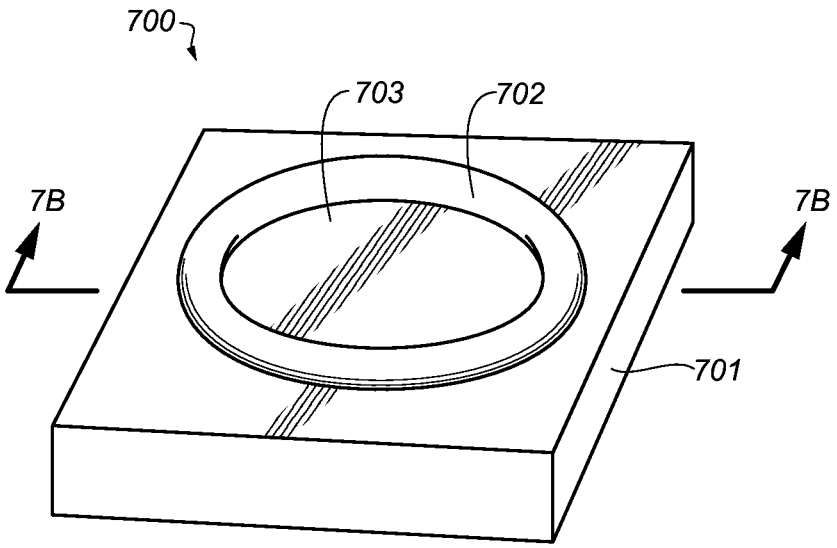
FIG. 7A is an isometric top view of an electronic device that includes a circular touch display connected to the electronic device via a sealing component.

FIG. 7A is an isometric top view of an electronic device 702 that includes a circular touch display 703 connected to the electronic device via a sealing component 702. The electronic device may be any kind of electronic device such as a smart phone, cellular telephone, computing device, tablet computing device, mobile computing device, laptop computing device, desktop computing device, wearable device, digital media player, and/or any other electronic device.

In various cases, the electronic device 701 may include various other components that are not shown. Such other components may include, but are not limited to, one or more processing units, one or more communication components, one or more non-transitory storage media (which may take the form of, but is not limited to, a magnetic storage medium; optical storage medium; magneto-optical storage medium; read only memory; random access memory; erasable programmable memory; flash memory; and so on), one or more input/output components, and/or any other components.

Further, although this example illustrates and describes a circular touch display 703 connected to an electronic device 701, it is understood that this is an example. In various implementations, any two components or devices may be sealed by the sealing component 702.

As illustrated, the sealing component 702 is an o-ring. However, it is understood that this is an example. In various cases, the sealing component may be configured in other ways other than as an o-ring without departing from the scope of the present disclosure.

Figure 7B:
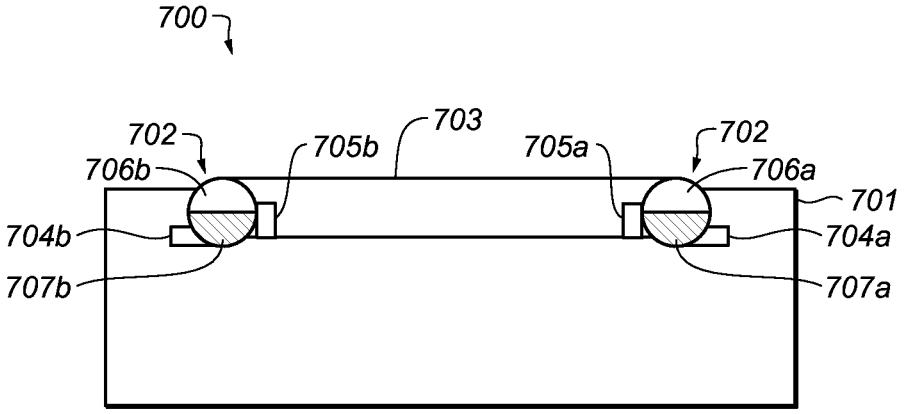
FIG. 7B is a cross-sectional view of the electronic device of FIG. 7A taken along line 7B of FIG. 7A.

FIG. 7B is a cross-sectional view of the electronic device 701 of FIG. 7A taken along line 7B of FIG. 7A. As illustrated, the sealing component 702 includes nonconductive elastomeric portions 706*a* and 706*b* and one conductive elastomeric portions 707*a* and 707*b*. Also as illustrated, the circular touch display 703 includes contacts 705*a* and 705*b* and the electronic device includes contacts 704*a* and 704*b*.

The sealing component 702 may operate to seal the circular touch display 703 to the electronic device 701. Such sealing may compress the conductive elastomeric portions 707*a* and 707*b* and electrically connect the contacts 706*a* and 706*b* to the contacts 704*a* and 704*b*, respectively.

As illustrated, sealing of the circular touch display 703 to the electronic device 701 may isolate the conductive elastomeric portions 707*a* and 707*b* of the sealing component 702 from an environment external to the circular touch display and the electronic device. This may be accomplished by facing the nonconductive elastomeric portions 706*a* and 706*b* toward such external environment in order to isolate the conductive elastomeric portions.

However, conductive elastomeric portion 707*a* and 707*b* of such a sealing component 702 may not be isolated from an external environment when sealed in various implementations. For example, FIG. 7C is a cross-sectional view of an alternative embodiment of the electronic device of FIG. 7B where conductive elastomeric portions 707*a* and 707*b* of a sealing component 702 are not be isolated from an external environment when sealing a circular display 703 to an electronic device 701.

Although the sealing component 702 is illustrated and described as including a particular number and configurations of nonconductive elastomeric portions 706*a* and 706*b* and/or conductive elastomeric portions 707*a* and 707*b*, it is understood that this is an example. Other numbers and/or configurations of nonconductive elastomeric portions 706*a* and 706*b* and/or conductive elastomeric portions 707*a* and 707*b* are possible and contemplated without departing from the scope of the present disclosure.

Figure 7C:
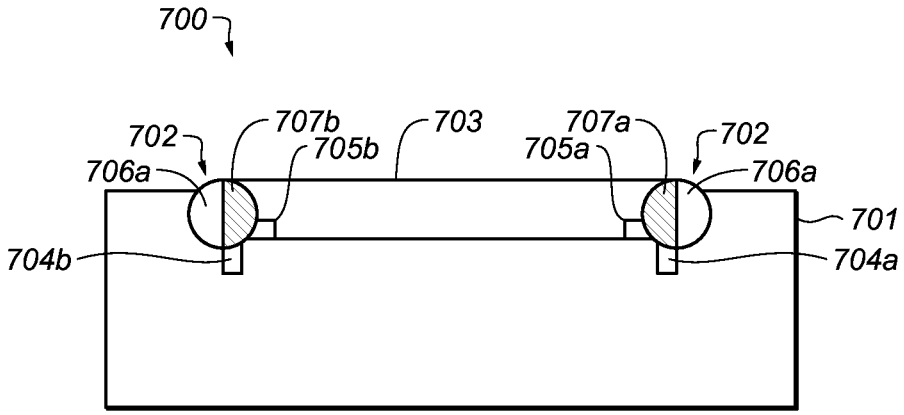
FIG. 7C is a cross-sectional view of an alternative embodiment of the electronic device of FIG. 7B.

For example, the embodiments in FIGS. 7B and 7C illustrate sealing components 702 that are o-rings which have half a diameter composed of nonconductive elastomeric portions 706*a* and 706*b* and half a diameter composed of conductive elastomeric portions 707*a* and 707*b*. However, in some implementations such an o-ring may have conductive elastomeric inner portions and nonconductive material outer portions of various shapes (such as a tapered column of conductive elastomeric material in the middle surrounded by nonconductive elastomeric material, a column of conductive elastomeric material in the middle that narrows from a wider portion on the top to a middle point and widens from the middle point to a bottom point that is surrounded by conductive elastomeric material, and so on).

Further in various implementations such an o-ring may be composed of alternating segments of conductive and nonconductive elastomeric material running around the circumference of the o-ring. In still other implementations, the sealing component 702 may be a component that is operable to seal other than an o-ring such as a gasket or other member.

In one or more implementations, the conductive elastomeric portions 707*a* and 707*b* may be surrounded and isolated from additional conductive material that is connectible to a ground to shield the conductive elastomeric portions 707*a* and 707*b*. In yet other embodiments, the conductive material (and/or the nonconductive material) may extend outwardly from a circumference of the elastomeric connector to form protrusions. These protrusions may be compressed when the connector is seated, thereby providing a snug electrical connection or snug insulating connection.

Figure 8:
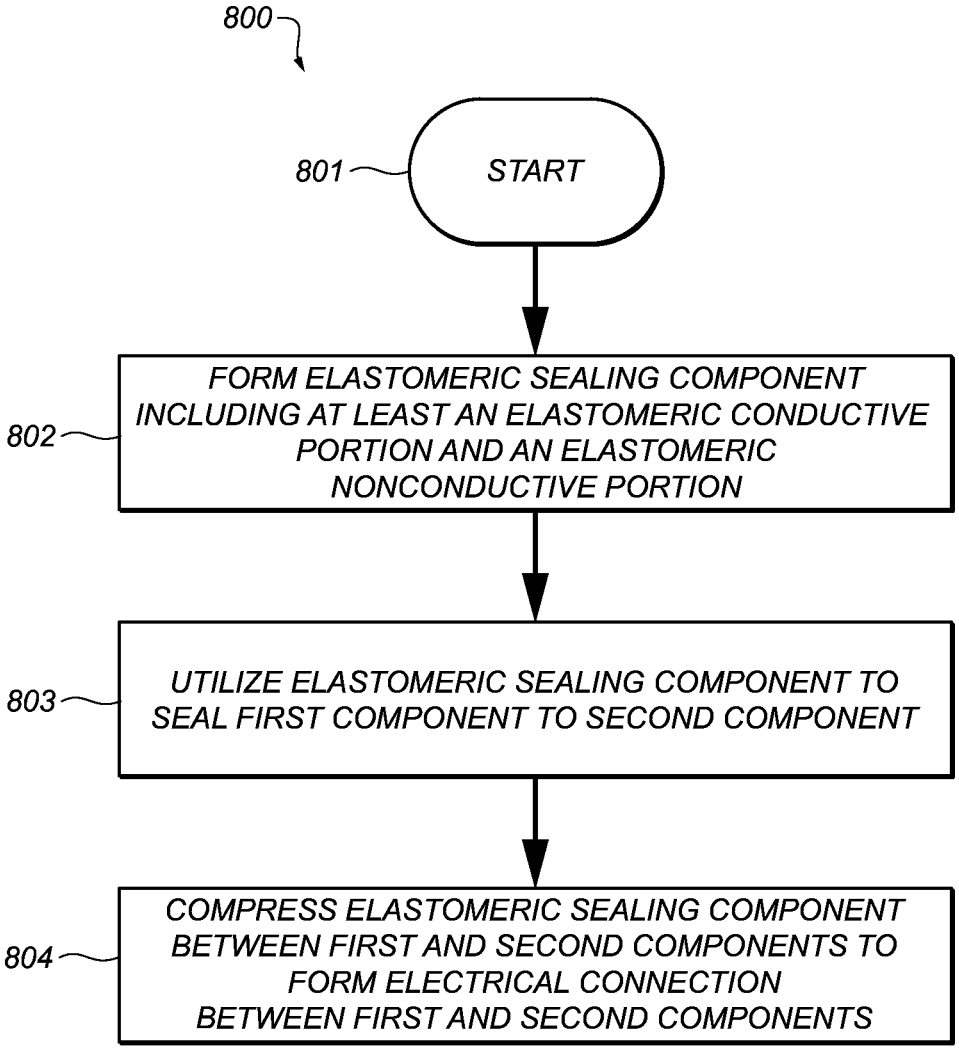
FIG. 8 is a method diagram illustrating an example method for sealing and forming an electrical connection between two components. This method may be performed by the electronic device, the circular display, and/or the sealing component of FIG. 7A-7B or 7C.

FIG. 8 is a method diagram illustrating an example method for sealing and forming an electrical connection between two components. This method may be performed by the electronic device 701, the circular display 703, and/or the sealing component 702 of FIG. 7A-7B or 7C.

The flow begins at block 801 and proceeds to block 802 where a sealing component including at least an elastomeric conductive portion and an elastomeric nonconductive portion is formed. The flow then proceeds to block 803 where the sealing component is utilized to seal a first component to a second component. Next, the flow proceeds to block 804 where the sealing component is compressed between the first and second components to form at least one electrical connection between the first and second components.

Although the method 800 is illustrated and described as including particular operations performed in a particular order, it is understood that this is an example. In various implementations, other configurations of the same, similar, and/or different operations may be performed without departing from the scope of the present disclosure.

For example, operations 803 and 804 are shown as separate operations performed in a linear order. However, in various implementations, sealing of the two components and compression of the sealing components to form electrical connection between the first and second components may be performed simultaneously.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages.

The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. An elastomeric connector system, comprising:

an elastomeric connector comprising:

at least one conductive elastomeric material portion extending between at least a first connection surface and a second connection surface; and at least one nonconductive elastomeric material portion; and at least one guide element that at least partially surrounds the elastomeric connector and transfers compression, in multiple directions along the elastomeric connector, from the first connection surface to the second connection surface; wherein:

the at least one nonconductive elastomeric material portion isolates the at least one conductive elastomeric material portion from the at least one guide element;

the at least one guide element is conductive and is coupled to a ground; and the at least one guide element acts as a shield for the at least one conductive elastomeric material portion.

2. The elastomeric connector system of claim 1, wherein the at least one guide element comprises a hollow tube.

3. The elastomeric connector system of claim 1, wherein the at least one guide element guides the elastomeric connector around at least one component that is positioned between the first connection surface and the second connection surface.

4. The elastomeric connector system of claim 1, wherein the elastomeric connector is compressed between a first contact of a first component that contacts the first connection surface and a second contact of a second component that contacts the second connection surface.

5. The elastomeric connector system of claim 1, wherein the elastomeric connector is at least one of formed prior to insertion in the at least one guide element or formed at least partially inside the at least one guide element.

6. The elastomeric connector system of claim 1, wherein:

the at least one conductive elastomeric material portion comprises at least a first conductive elastomeric material portion, a second conductive elastomeric material portion; and a third conductive elastomeric material portion;

the first conductive elastomeric material portion is separated from the second conductive elastomeric material portion by the at least one nonconductive elastomeric material portion in a cross section of the first connection surface; and the first conductive elastomeric material portion is separated from the third conductive elastomeric material portion by the at least one nonconductive elastomeric material portion in an area not within the cross section of the first connection surface.

7. The elastomeric connector system of claim 1, wherein at least one of:

the first conductive elastomeric material portion is connected to the second conductive elastomeric material portion within the elastomeric connector; or the first conductive elastomeric material portion is connected to the third conductive elastomeric material portion within the elastomeric connector.

8. An elastomeric connector comprising:

a first conductive elastomeric material portion extending between at least a first connection surface and a second connection surface;

a second conductive elastomeric material portion extending between the first connection surface and the second connection surface;

a third conductive elastomeric material portion extending between the first connection surface and a second connection surface; and at least one nonconductive elastomeric material portion; wherein:

the first conductive elastomeric material portion is separated from the second conductive elastomeric material portion by the at least one nonconductive elastomeric material portion in a cross section of the first connection surface;

the first conductive elastomeric material portion is separated from the third conductive elastomeric material portion by the at least one nonconductive elastomeric material portion in an area not within the cross section of the first connection surface; and the second conductive elastomeric material portion surrounds the first conductive elastomeric portion, the third conductive elastomeric portion, and the at least one nonconductive elastomeric material portion in at least one plane.

9. The elastomeric connector of claim 8, wherein at least one of:

the first conductive elastomeric material portion is connected to the second conductive elastomeric material portion within the elastomeric connector; or the first conductive elastomeric material portion is connected to the third conductive elastomeric material portion within the elastomeric connector.

10. The elastomeric connector of claim 8, wherein the elastomeric connector is operable as a sealing component to seal at least a first component to a second component.

11. The elastomeric connector of claim 10, wherein the first conductive elastomeric material portion, the second conductive elastomeric material portion, and the third conductive elastomeric material portion are separated from an external environment by the at least one nonconductive elastomeric material portion when the elastomeric connector seals the first component to the second component.

12. The elastomeric connector of claim 8, wherein the second conductive elastomeric material portion is operable to shield the first conductive elastomeric portion and the third conductive elastomeric portion when connected to a ground.

13. A sealing component system, comprising:

at least one conductive elastomeric material portion; and at least one nonconductive elastomeric material portion; wherein:

the sealing component is operable to seal at least a first component to a second component; and the at least one conductive elastomeric material portion is separated from an external environment by the at least one nonconductive elastomeric material portion when the sealing component seals the first component to the second component.

14. The sealing component system of claim 13, wherein the at least one conductive elastomeric material portion electrically connects a first contact of the first component to a second contact of the second component when the sealing component seals the first component to the second component.

15. The sealing component system of claim 13, wherein the sealing component comprises an o-ring.

16. The sealing component of claim 13, wherein the at least one conductive elastomeric material portion extends between at least a first connection portion and a second connection portion.

17. The sealing component system of claim 16, wherein:

the at least one conductive elastomeric material portion comprises at least a first conductive elastomeric material portion, a second conductive elastomeric material portion; and a third conductive elastomeric material portion;

the first conductive elastomeric material portion is separated from the second conductive elastomeric material portion by the at least one nonconductive elastomeric material portion in a cross section of the first connection portion; and the first conductive elastomeric material portion is separated from the third conductive elastomeric material portion by the at least one nonconductive elastomeric material portion in an area not within the cross section of the first connection portion.

18. The sealing component system of claim 17, wherein at least one of:

the first conductive elastomeric material portion is connected to the second conductive elastomeric material portion within the elastomeric connector; or the first conductive elastomeric material portion is connected to the third conductive elastomeric material portion within the elastomeric connector.

19. The sealing component system of claim 13, further comprising the first component and the second component.

20. A method of electrically coupling two components, the method comprising:

placing an elastomeric connector at least partially within at least one guide element that is conductive, the at elastomeric connector comprising:

at least one conductive elastomeric material portion extending between at least a first connection surface and a second connection surface; and at least one nonconductive elastomeric material portion that isolates the at least one conductive elastomeric material portion from the at least one guide element;

coupling the at least one guide element to a ground such that the at least one guide element acts as a shield for the at least one conductive elastomeric material portion;

electrically connecting a first component to a second component by contacting the first component to the first connection surface and the second component to the second connection surface; and transferring compression of the elastomeric connector associated with contact of the first component to the first connection surface from the first connection surface through the elastomeric connector in at least two directions to the second connection surface utilizing the at least one guide element.

21. A method for electrically coupling and sealing two components, the method comprising:

sealing a first component to a second component utilizing a sealing component that includes at least one elastomeric conductive portion and at least one elastomeric nonconductive portion such that the at least one elastomeric conductive portion is separated from an external environment by the at least one elastomeric nonconductive portion; and compressing the sealing component between the first component and the second component to form an electrical connection between the first component and the second component utilizing the at least one elastomeric conductive portion.

* * * * *